US009925778B2

(12) United States Patent
Harada et al.

(10) Patent No.: US 9,925,778 B2
(45) Date of Patent: Mar. 27, 2018

(54) LIQUID EJECTING APPARATUS

(71) Applicant: SEIKO EPSON CORPORATION, Tokyo (JP)

(72) Inventors: Shuhei Harada, Chino (JP); Izumi Nozawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/415,545

(22) Filed: Jan. 25, 2017

(65) Prior Publication Data

US 2017/0210135 A1 Jul. 27, 2017

(30) Foreign Application Priority Data

Jan. 27, 2016 (JP) ..... 2016-013057

(51) Int. Cl.
*B41J 2/165* (2006.01)

(52) U.S. Cl.
CPC ..... *B41J 2/16511* (2013.01)

(58) Field of Classification Search
CPC ..... B41J 2/16511; B41J 2/16505; B41J 2/16547; B41J 2/16552; B41J 2002/16502; B41J 2002/16514; B41J 2/16517
See application file for complete search history.

(56) References Cited

U.S. PATENT DOCUMENTS 5,757,395 A * 5/1998 Chew ..... B41J 2/16511 347/24
5,946,009 A * 8/1999 Youn ..... B41J 2/16547 347/22
6,203,136 B1 * 3/2001 Takahashi ..... B41J 2/16508 347/29
6,422,681 B1 * 7/2002 Berg ..... B41J 2/16511 347/32
2009/0073221 A1 * 3/2009 Yoda ..... B41J 2/16511 347/33
2009/0102884 A1 * 4/2009 Kawakami ..... B41J 2/16511 347/32
2009/0141073 A1 * 6/2009 Umeda ..... B41J 2/16511 347/30
2010/0214356 A1 * 8/2010 Maida ..... B41J 2/16552 347/28
2011/0050799 A1 * 3/2011 Nishida ..... B41J 2/16511 347/30
2011/0090281 A1 * 4/2011 Miyazawa ..... B41J 2/16547 347/30
2011/0090282 A1 * 4/2011 Miyazawa ..... B41J 2/16547 347/33
2011/0102494 A1 * 5/2011 Miyazawa ..... B41J 2/16547 347/20
2012/0147090 A1 * 6/2012 Sato ..... B41J 23/025 347/32
2015/0239249 A1 * 8/2015 Plummer ..... B41J 2/16505 347/29

FOREIGN PATENT DOCUMENTS

JP 2001-018403 1/2001

* cited by examiner

*Primary Examiner* — Patrick King
(74) *Attorney, Agent, or Firm* — Workman Nydegger

(57) ABSTRACT

A liquid ejecting apparatus includes a liquid ejecting head including a nozzle which ejects liquid, and an opening face to which the nozzle opens; a cap which forms a closed space between the cap and the opening face; and a holder which holds the cap so as to move in a tilting manner in a direction which goes along the opening face.

11 Claims, 11 Drawing Sheets

LIQUID EJECTING APPARATUS

BACKGROUND

1. Technical Field

The present invention relates to a liquid ejecting apparatus such as a printer.

2. Related Art

As an example of a liquid ejecting apparatus, there is an ink jet printer in which a positioning wall protrudes from a recording head carriage which includes a nozzle unit, an engaging pin which moves in conjunction with a cap member is provided, and the cap member is positioned with respect to the nozzle unit, when the positioning wall is engaged with the engaging pin at a time of a movement of the recording head carriage (for example, JP-A-2001-18403).

According to the above described configuration, it is possible to position the cap member with respect to the nozzle unit by moving the cap member in two directions of a movement direction of the recording head carriage and a scanning direction of a recording medium which intersects the movement direction.

Meanwhile, in a case in which the recording head carriage and the nozzle unit (liquid ejecting head) are manufactured as separate bodies, and a product is completed by attaching the nozzle unit to the recording head carriage, there is a case in which the nozzle unit is attached to the recording head carriage in a state of being tilted to the recording head carriage. In this case, even when the engaging pin on the cap member side is caused to be engaged with a positioning wall on the recording head carriage side, and the cap member is positioned with respect to the recording head carriage, there is a problem in that it is not possible to cause the cap member to be in contact with the tilted nozzle unit, appropriately.

Such a problem is not limited to a printer which performs printing by ejecting ink, and is generally common to a liquid ejecting apparatus in which a nozzle included in a liquid ejecting head is covered by a cap.

SUMMARY

An advantage of some aspects of the invention is to provide a liquid ejecting apparatus in which it is possible to appropriately position a cap with respect to a liquid ejecting head.

Hereinafter, means of the invention, and operational effects thereof will be described.

According to an aspect of the invention, there is provided a liquid ejecting apparatus which includes a liquid ejecting head including a nozzle which ejects liquid, and an opening face to which the nozzle opens; a cap which forms a closed space between the cap and the opening face; and a holder which holds the cap so as to move in a tilting manner in a direction which goes along the opening face.

According to the configuration, even in a case in which the liquid ejecting head is tilted in the direction which goes along the opening face, it is possible to appropriately position the cap with respect to the liquid ejecting head, when the cap moves in a tilting manner with respect to the holder.

The liquid ejecting apparatus may further include a plurality of the liquid ejecting heads, a plurality of the caps which are provided corresponding to the plurality of liquid ejecting heads, individually, a plurality of the holders which are provided corresponding to the plurality of caps, individually, and a support member which supports the plurality of holders.

According to the configuration, even in a case in which the plurality of liquid ejecting heads are tilted in different directions, when the plurality of caps corresponding to the plurality of holders supported by the support member move in a tilting manner, individually, it is possible to appropriately position a corresponding cap with respect to the plurality of liquid ejecting heads.

The liquid ejecting apparatus may further include an urging member which urges the cap in a direction of getting closer to the opening face.

According to the configuration, even in a case in which the opening face of the liquid ejecting head is tilted to a predetermined reference face, it is possible to cause the cap to be in contact with the liquid ejecting head, appropriately, when the urging member urges the cap in a direction of getting closer to the liquid ejecting head.

In the liquid ejecting apparatus, the cap may move between a capping position at which the closed space is formed and an open position which is separated from the capping position.

According to the configuration, it is possible to adjust a position of the cap in a process of moving to the capping position, by causing the cap to relatively move with respect to the liquid ejecting head.

The liquid ejecting apparatus may further include a carriage which reciprocates in a state in which the liquid ejecting head is mounted thereon, and a support member which supports the holder, in which the cap may move along with the support member in conjunction with a movement of the carriage.

According to the configuration, since the cap moves along with the support member in conjunction with a movement of the carriage, it is possible to move the cap at an appropriate timing, without separately performing a control for moving the cap. In addition, it is possible to make a configuration simple, compared to a case in which a driving source for moving the cap is separately provided.

The liquid ejecting apparatus may further include a support member which supports the holder, and an urging member which is provided between the holder and the support member, and urges the cap in a direction of getting closer to the opening face through the holder.

According to the configuration, it is possible to cause the cap to follow a posture of the liquid ejecting head by increasing a degree of freedom in displacement of the cap, by adopting a configuration in which the urging member urges the cap through the holder.

In the liquid ejecting apparatus, when a direction in which the nozzle ejects liquid is set to an ejecting direction, the liquid ejecting head may include a side wall which extends in a direction which intersects both of the ejecting direction and the opening face, the cap may include a plurality of engaging protrusions which align in a direction in which the side wall extends in a form of being engaged with the side wall, when moving in a direction of getting closer to the liquid ejecting head, and a cap urging member which is disposed between the cap and the holder, and urges the cap in a direction in which the plurality of engaging protrusions get closer to the side wall may be provided.

According to the configuration, when the liquid ejecting head is in contact with any one of the engaging protrusions which protrude from the cap, it is possible to move the cap in a tilting manner using an urging force of the cap urging member until another engaging protrusion comes into contact with the liquid ejecting head.

In the liquid ejecting apparatus, when the side wall is set to a first side wall, the engaging protrusion is set to a first engaging protrusion, and the cap urging member is set to a first urging member, the liquid ejecting head may include a second side wall which extends in a direction which intersects both of the opening face and the first side wall, the cap may include a plurality of second engaging protrusions which align in a direction in which the second side wall extends in a form of being engaged with the second side wall when the cap moves in a direction of getting closer to the liquid ejecting head, and a second urging member which is disposed between the cap and the holder, and urges the cap in a direction in which the plurality of second engaging protrusions get closer to the second side wall may be provided.

According to the configuration, since it is possible to set so that the cap is moved in a tilting manner using an urging force of the first urging member, when the liquid ejecting head is in contact with the first engaging protrusion which protrudes from the cap, and is moved in a tilting manner using an urging force of the second urging member, when the liquid ejecting head is in contact with the second engaging protrusion, the cap can be further accurately positioned, by being moved in a plurality of directions in a tilting manner.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, an embodiment of a liquid ejecting apparatus will be described with reference to drawings. The liquid ejecting apparatus is, for example, an ink jet printer which performs recording (printing) by ejecting ink as an example of liquid onto a medium such as a sheet.

Figure 1:
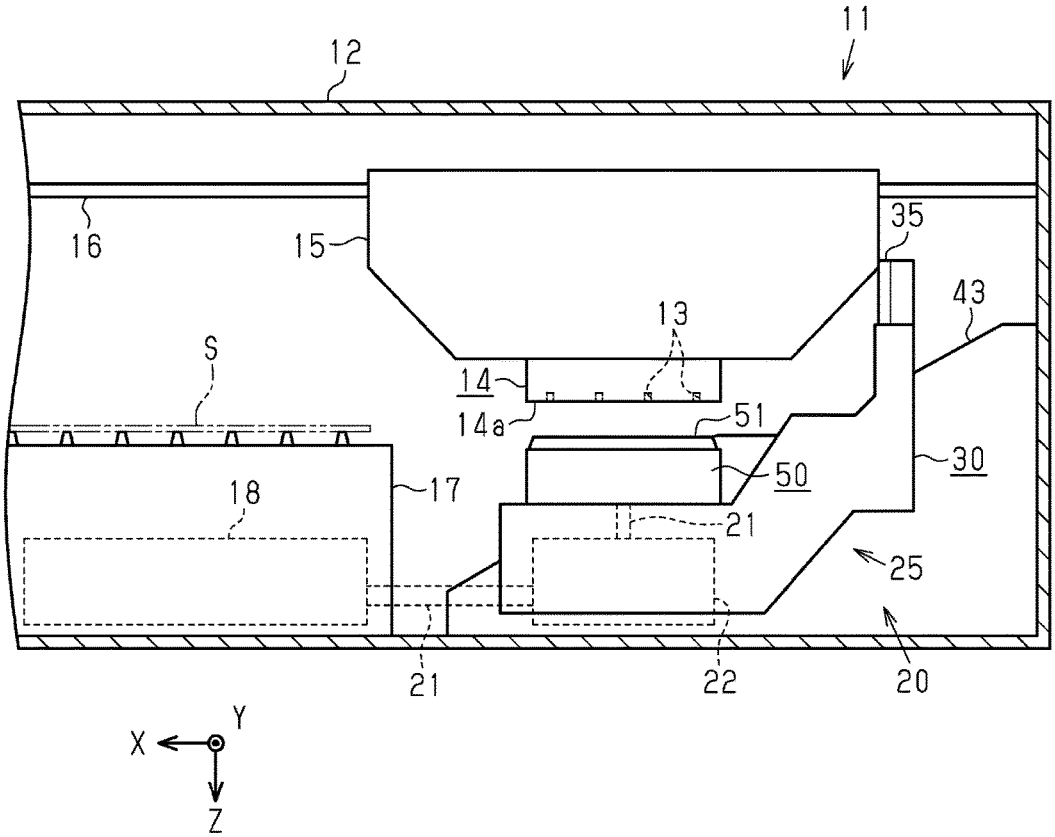
FIG. 1 is a sectional view which schematically illustrates a configuration of a liquid ejecting apparatus according to a first embodiment.

As illustrated in FIG. 1, a liquid ejecting apparatus 11 is provided with a housing 12, a medium support unit 17 for supporting a medium S, a liquid ejecting head 14 which includes a plurality of nozzles 13 which eject liquid as liquid droplets, and an opening face 14*a* to which the nozzle 13 is open, a carriage 15 which reciprocates in a state in which the liquid ejecting head 14 is mounted thereon, and a guiding shaft 16 which guides a movement of the carriage 15.

In the embodiment, a direction in which the liquid ejecting head 14 ejects liquid is referred to as an ejecting direction Z, a direction in which the medium S is transported on the medium support unit 17 is referred to as a transport direction Y, and a movement direction on an outward path of the liquid ejecting head 14 is referred to as a movement direction X. In the embodiment, the ejecting direction Z is a vertically lower direction (gravity direction), and the ejecting direction Z, the transport direction Y, and the movement direction X are directions which intersect (orthogonal, preferably) each other. In addition, the liquid ejecting apparatus 11 performs printing (recording) when the liquid ejecting head 14 ejects liquid from the nozzle 13 toward the medium S which is supported by the medium support unit 17.

In the embodiment, a start end side in a movement on the outward path (right side in FIG. 1) in a movement region of the liquid ejecting head 14 which goes along the movement direction X is referred to as a home side, and a terminal end side in the movement on the outward path (left side in FIG. 1) is referred to as a side opposite to the home side.

The liquid ejecting apparatus 11 is provided with a maintenance unit 20 which is disposed at an end on the home side, for example, in the housing 12. The maintenance unit 20 is provided with a cap unit 25 including a cap 50 which forms a closed space between the cap and the opening face 14*a*, a suctioning tube 21 of which an upstream end is connected to the cap 50, and a suctioning pump 22 which is provided in the middle of the suctioning tube 21. A downstream end of the suctioning tube 21 is connected to a waste liquid container 18. The waste liquid container 18 is disposed under the medium support unit 17, or the like, for example.

The maintenance unit 20 performs suctioning cleaning in which liquid in the liquid ejecting head 14 is discharged as waste liquid through the nozzle 13, by suctioning the closed space which is formed by the cap 50 using the suctioning pump 22, in order to preferably maintain ejecting properties of the liquid ejecting head 14. The waste liquid discharged from the liquid ejecting head 14 using the suctioning cleaning is introduced to the waste liquid container 18 thorough the suctioning tube 21.

Figure 2:
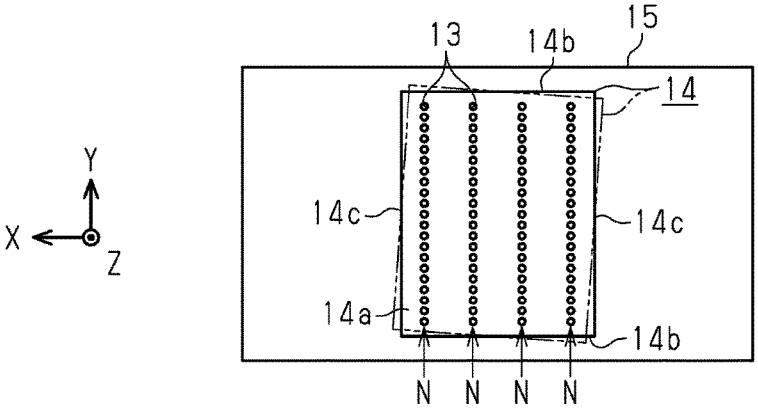
FIG. 2 is a bottom view of a carriage and a liquid ejecting head according to the first embodiment.

As illustrated in FIG. 2, the liquid ejecting head 14 is formed in an approximately rectangular parallelepiped shape of which an upper side is attached to the carriage 15, and a bottom face thereof is set to an opening face 14*a*. The liquid ejecting head 14 includes side walls 14*b* and 14*c* which extend in a direction which intersects both of the ejecting direction Z and the opening face 14*a*. According to the embodiment, two side walls 14*b* which form a pair extend in the movement direction X, and two side walls 14*c* which form a pair extend in the transport direction Y. In the liquid ejecting head 14, the plurality of nozzles 13 are disposed so as to form nozzle columns N which align in the transport direction Y.

Figure 3:
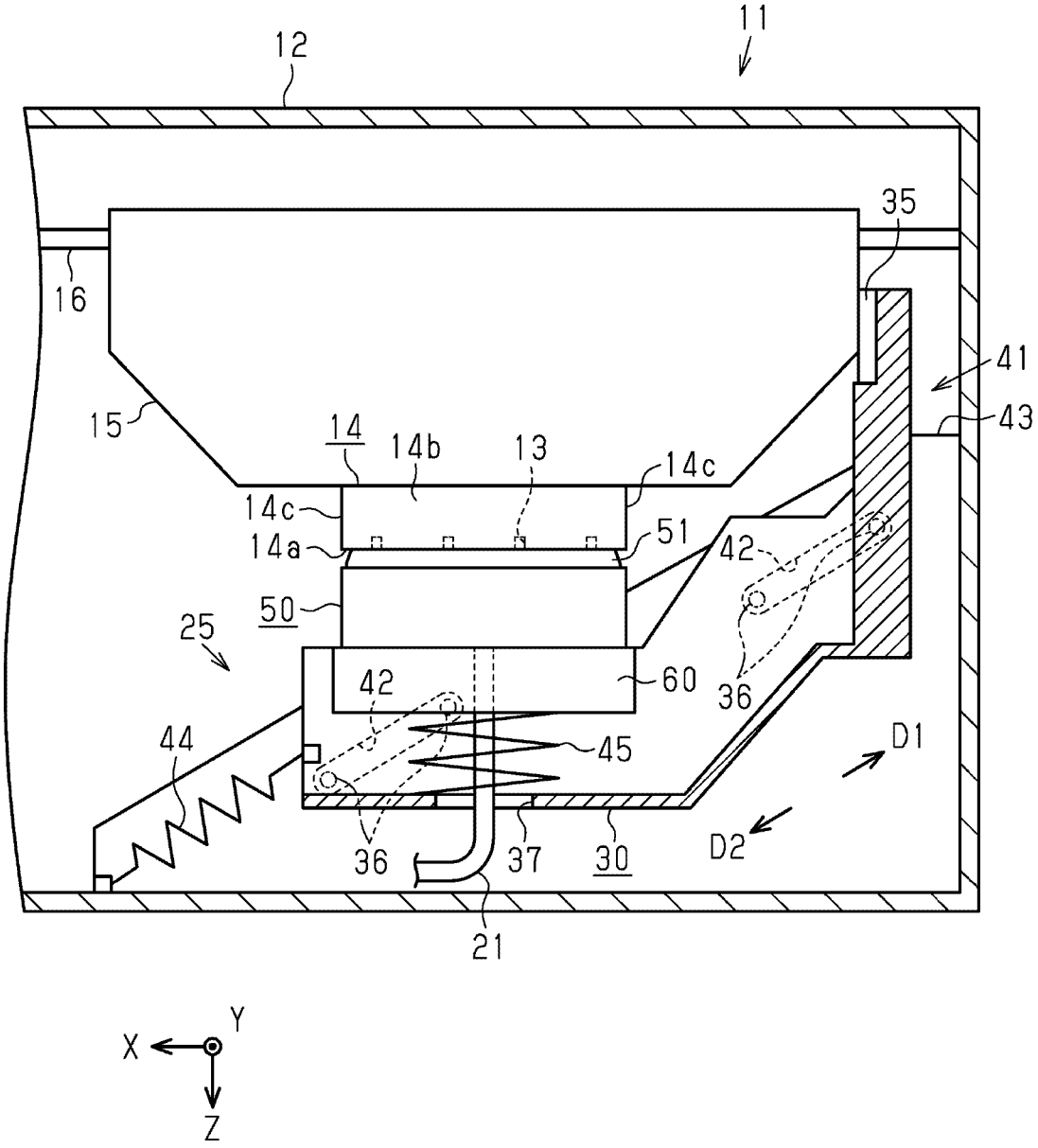
FIG. 3 is a sectional view which schematically illustrates a configuration of a maintenance unit according to the first embodiment.

As illustrated in FIG. 3, the cap unit 25 is provided with a holder 60 which holds the cap 50, an urging member 45 which urges the cap 50 in a direction of getting closer to the opening face 14*a*, and a support member 30 which supports the cap 50, the holder 60, and the urging member 45. It is preferable for the cap 50 to include a lip portion 51 which is formed of an annular elastic member on the upper part as the opening face 14*a* side. The urging member 45 is formed of, for example, a plate spring or a coil spring, is disposed between the holder 60 and the support member 30, and urges the cap 50 through the holder 60. In addition, an insertion hole 37 for causing the suctioning tube 21 to pass thorough is provided at a bottom portion of the support member 30.

The liquid ejecting apparatus 11 is provided with a movement mechanism 41 which is configured so as to relatively move the cap 50 with respect to the liquid ejecting head 14. According to the embodiment, since the cap 50 is disposed on the lower part of the liquid ejecting head 14, the movement mechanism 41 cause the cap 50 to move upward in a first direction D1 (obliquely upward) which is a direction of getting closer to the liquid ejecting head 14, or to move downward in a second direction D2 (obliquely downward) which is a direction of separating from the liquid ejecting head 14.

The movement mechanism 41 includes an engaging unit 35 which protrudes on a movement path of the carriage 15 from the support member 30, a plurality of guided shaft portions 36 (refer to FIG. 6 together) which protrude in a direction which goes along the transport direction Y from the support member 30, a guiding plate 43 which includes a guiding groove 42 to which the guided shaft portion 36 is inserted, and the urging member 44 which urges the support member 30. The guiding plate 43 is provided separately from the support member 30, and is disposed in a fixing manner so as to form a pair on an upstream side in the transport direction Y and a downstream side in the transport direction Y of the support member 30. In the guiding plate 43 which forms a pair, the guiding groove 42 includes a portion which extends obliquely upward from a start end (lower end in FIG. 3) toward a terminal end (upper end in FIG. 3).

The urging member 44 is, for example, a spring of which one end is locked to the support member 30, and the other end is locked to the guiding plate 43, and urges the cap 50 in the second direction D2 of separating from the liquid ejecting head 14 through the support member 30.

When the carriage 15 is engaged with the engaging unit 35 which protrudes upward, by moving to the home side, the support member 30 moves toward the home side against an urging force of the urging member 44 by being pressed by the carriage 15. At this time, the cap 50 moves in the first direction D1 as an obliquely upward direction, along with the support member 30, when the guided shaft portion 36 of the support member 30 is guided from a start end position which is denoted by a two-dot dashed line in FIG. 3 to a terminal end position which is denoted by a dashed line in FIG. 3 along the guiding groove 42 of the guiding plate 43.

The cap 50 which moves in the first direction forms a closed space between the cap and the opening face 14*a* to which the nozzles 13 opens, when the lip portion 51 comes into contact with the liquid ejecting head 14. In this manner, when the cap 50 forms a closed space between the cap and the opening face 14*a*, it is referred to as "capping". In addition, a position of the liquid ejecting head 14 when capping is performed is referred to as a home position.

A position in which the cap 50 forms the closed space is set to a capping position (position illustrated in FIG. 3), and a position in which the cap 50 is separated from the capping position is set to an open position (position illustrated in FIG. 1). In this case, the cap 50 is configured so as to move between the capping position and the open position along with the support member 30, in conjunction with a movement of the carriage 15 which is engages with the engaging unit 35 which configures the movement mechanism 41.

In the liquid ejecting apparatus 11, the liquid ejecting head 14 moves to the home position at a power off time, or the like, in which liquid is not ejected. Since capping is performed when the cap 50 moves to the capping position in conjunction with the movement, it is possible to suppress drying of the nozzle 13.

In capping, when it is set so that the lip portion 51 of the cap 50 comes into contact with the opening face 14*a*, and the support member 30 slightly moves upward thereafter, the upward movement of the cap 50 is regulated by the liquid ejecting head 14, and the urging member 45 formed of a coil spring is deformed in a compressing manner. Then, the cap 50 is pressed by the liquid ejecting head 14 due to an urging force of the urging member 45 which is deformed in the compressing manner for performing a restoring deformation, and is in pressure contact with the opening face 14*a* due to an elastic deformation of the lip portion 51. In this manner, even in a case in which the liquid ejecting apparatus 11 is unnecessarily vibrated at a time of performing capping, it is possible to maintain airtightness of the closed space which is formed by the cap 50.

When the lip portion 51 which can be elastically deformed is provided at a portion of the cap 50 which comes into contact with the liquid ejecting head 14, it is possible to increase airtightness by making an interval between the cap 50 and the liquid ejecting head 14 small, at a time of performing capping.

In the liquid ejecting apparatus 11, in a case of starting printing, the carriage 15 moves in the movement direction X from the home position toward the side opposite to the home position. When the carriage 15 moves to the side opposite to the home position in this manner, in the support member 30, the guided shaft portion 36 moves in the second direction D2 while being guided by the guiding groove 42 of the guiding plate 43 due to an urging force of the urging member 44. In this manner, since the cap 50 moves to the open position from the capping position, capping is released without separately controlling an operation of the movement mechanism 41.

Figure 4:
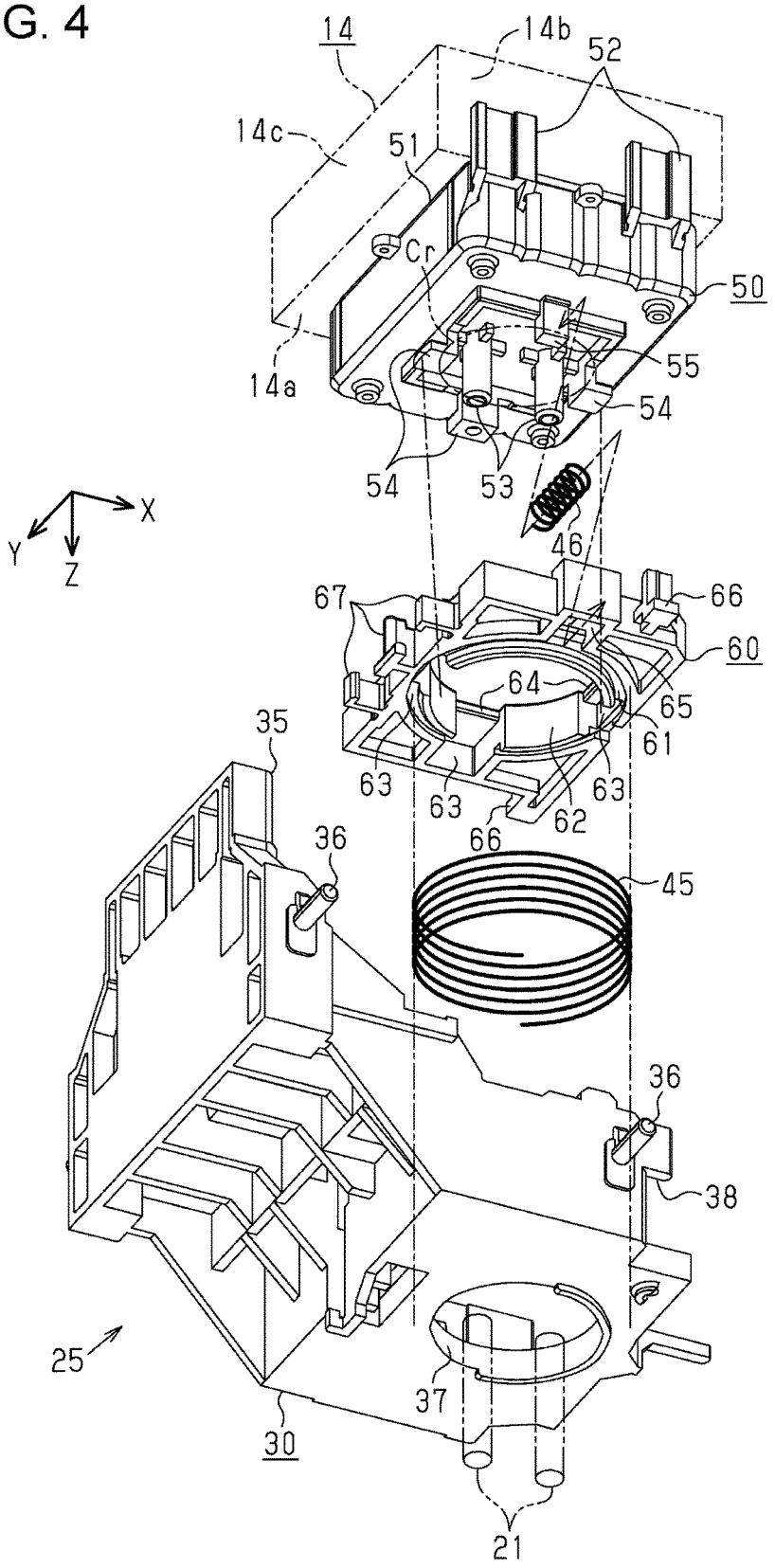
FIG. 4 is an exploded perspective view of a cap unit according to the first embodiment which is viewed from below.

As illustrated in FIG. 4, it is preferable for the cap 50 to include a plurality of (for example, two) engaging protrusions 52 which protrude upward compared to the lip portion 51, toward the liquid ejecting head 14. It is preferable for the cap unit 25 to be provided with a cap urging member 46 which is disposed between the cap 50 and the holder 60, and in which a plurality of engaging protrusions 52 urge the cap 50 in a direction (for example, transport direction Y) of getting closer to the side wall 14*b* of the liquid ejecting head 14.

The cap 50 is provided with a connection protrusion portion 53 which extends to the lower part from a bottom portion toward the holder 60, a plurality (for example, three) of tilting movement guiding units 54 which protrude from the bottom portion, and are engaged with the holder 60, and a pressure receiving protrusion portion 55 which protrudes downward from the bottom portion, similarly, and receives an urging force of the cap urging member 46.

It is preferable for the plurality of tilting movement guiding units 54 and the pressure receiving protrusion portion 55 to be disposed so as to align along a circumference of a circle Cr (may also be oval) which is located on a predetermined plane which is parallel to the opening face 14*a*. The pressure receiving protrusion portion 55 is disposed on the downstream side of the cap urging member 46 in the transport direction Y. The plurality of tilting movement guiding units 54 are bent at a tip end (lower end) toward the outside of the circle Cr.

The connection protrusion portion 53 is formed in a tube shape with a flow path which communicates with the closed space which is formed by the cap 50 in the inside. An upstream end of the suctioning tube 21 is connected to the connection protrusion portion 53. The connection protrusion portion 53 can be disposed in the circumference of the circle Cr in which the tilting movement guiding units 54 and the pressure receiving protrusion portion 55 are disposed, for example; however, the connection protrusion portion may be connected to the suctioning tube 21 by protruding to the side from the cap 50.

The holder 60 includes a locking recessed portion 61 with which an upper end of the urging member 45 is engaged, a through hole 62 formed in an approximately cylindrical shape, a guiding recessed portion 63 which is provided in a recessed manner in a state of opening to the through hole 62, a positioning protrusion portion 64 which is provided so as to cover a part of an opening of the guiding recessed portion on the upper side, an accommodating recessed portion 65 which accommodates the cap urging member 46, and engaging protrusion portions 66 and 67 which are engaged with the support member 30.

According to the embodiment, it is preferable that the circle Cr in which the tilting movement guiding units 54 and the pressure receiving protrusion portion 55 of the cap 50 are disposed, the cylindrical through hole 62, and the urging member 45 which is formed of a cylindrical coil spring be disposed so as to form an approximately concentric circle.

An opening on the upper side of the guiding recessed portion 63 is set to a minimum width into which the bent tip end of the tilting movement guiding units 54 can be inserted from above, and the tilting movement guiding units 54 enters a state in which the bent tip end is engaged with the positioning protrusion portion 64 from below, by moving the cap 50 in the transport direction Y, after being inserted through the through hole 62 through the opening. In addition, the connection protrusion portion 53 and the pressure receiving protrusion portion 55 of the cap 50 enter a state of being inserted into the through hole 62 of the holder 60.

At this time, the cap 50 enters a state in which the cap can relatively move with respect to the holder 60 in a range in which the tilting movement guiding units 54 can move in the guiding recessed portion 63 in a direction which intersects the ejecting direction Z. When the cap urging member 46 is accommodated in the accommodating recessed portion 65 in a state of being compressed so as to be smaller than a natural length, the cap urging member 46 presses the pressure receiving protrusion portion 55, and the plurality of engaging protrusions 52 are urged in a direction of getting closer to the side wall 14*b* (transport direction Y in the embodiment) of the liquid ejecting head 14, in the cap 50. In addition, in the guiding recessed portion 63, a length in the transport direction Y may be set so that a movement of the tilting movement guiding units 54 which goes along an urging direction of the cap urging member 46 (transport direction Y) is allowed, and meanwhile, a length in the movement direction X may be set so that a movement of the tilting movement guiding units 54 which goes along the movement direction X orthogonal to the transport direction Y is regulated.

Figure 5:
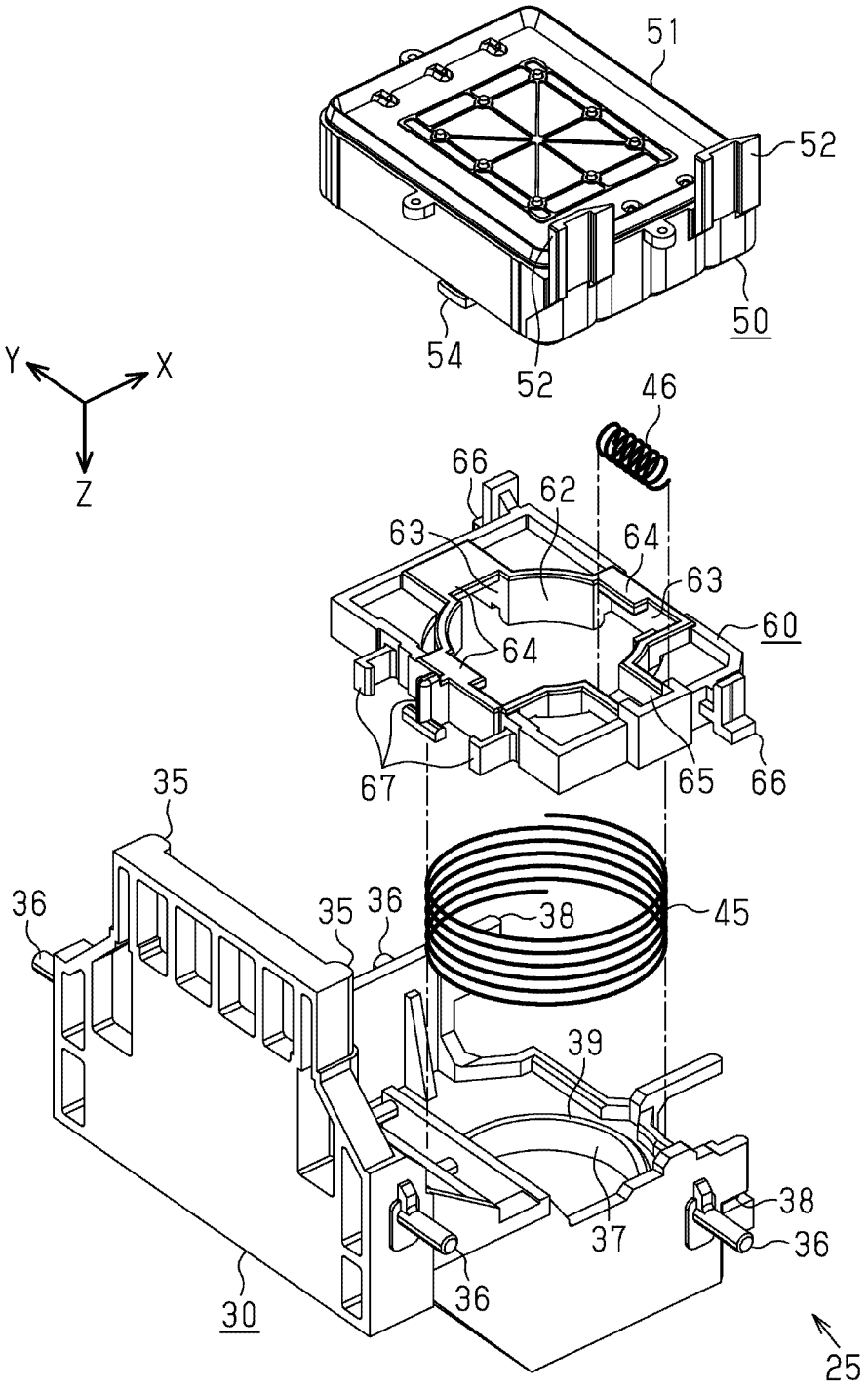
FIG. 5 is an exploded perspective view of the cap unit according to the first embodiment which is viewed from above.

As illustrated in FIG. 5, the support member 30 includes a protrusion portion 38 with which the engaging protrusion portion 66 of the holder 60 is engaged, and a locking protrusion portion 39 with which a lower end of the urging member 45 is engaged. The holder 60 which is urged upward by the urging member 45 is held in the support member 30 when the engaging protrusion portion 66 is locked to the protrusion portion 38 of the support member 30.

Figure 6:
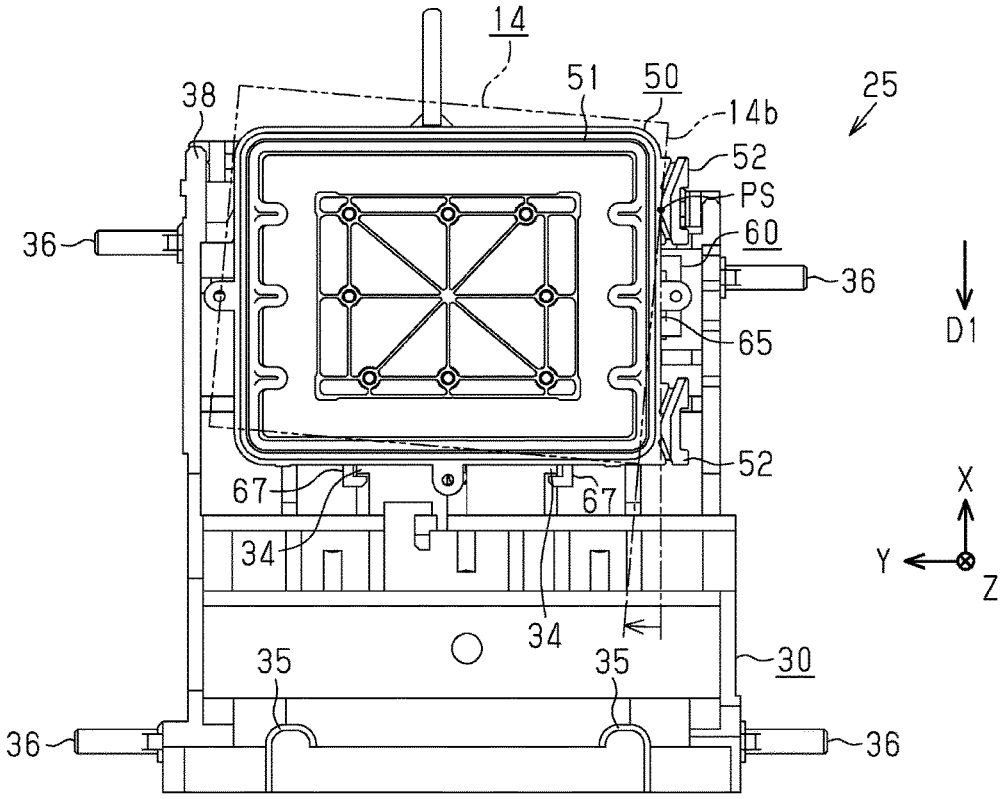
FIG. 6 is a plan view of the cap unit according to the first embodiment.

As illustrated in FIG. 6, a guiding protrusion portion 34 with which the engaging protrusion portion 67 of the holder 60 is engaged is provided in the support member 30 so as to extend along the ejecting direction Z. When the holder 60 moves upward with respect to the support member 30 due to expansion or contraction of the urging member 45 at a time of capping, the engaging protrusion portion 67 is guided to the guiding protrusion portion 34.

Subsequently, an operation of the liquid ejecting apparatus 11 according to the embodiment will be described.

As denoted by a solid line in FIG. 2, the liquid ejecting head 14 is designed so as to be attached to the carriage 15, so that the side wall 14*b* extends in the movement direction X, and the side wall 14*c* extends in the transport direction Y. However, as denoted by a two-dot dashed line in FIG. 2, there is a case in which the liquid ejecting head 14 is attached to the carriage 15 in a state of being tilted in the movement direction X and the transport direction Y, when viewed from a bottom face side.

In this case, the liquid ejecting head 14 is attached to the carriage 15 in a state in which the liquid ejecting head is tilted as if the liquid ejecting head rotates around a rotating shaft which extends in a direction intersecting the opening face 14*a*. In this case, there is a concern that the lip portion 51 may come into contact with the opening of the nozzle 13, or the opening of the nozzle 13 may be protruded to the outside of the close space, due to a shift of a position with which the cap 50 comes into contact, when performing capping.

In this point, in the liquid ejecting apparatus 11 according to the embodiment, when the cap 50 comes into contact with the liquid ejecting head 14 by moving in the first direction D1, along with the support member 30, first, the engaging protrusion 52 of the cap 50 comes into contact with the side wall 14*b* of the liquid ejecting head 14.

At this time, as denoted by a two-dot dashed line in FIG. 6, when the side wall 14*b* of the liquid ejecting head 14 is tilted in the movement direction X, the plurality of engaging protrusions 52 do not come into contact with the side wall 14*b* at the same time, and for example, an engaging protrusion 52 on the rear side in the first direction D1 firstly comes into contact with the side wall 14*b*.

When the cap 50 and the liquid ejecting head 14 further perform a relative movement along the first direction D1 in this state, the cap 50 moves in a tilting manner in a rotating form, in a direction denoted by an arrow in FIG. 6, until another engaging protrusion 52 comes into contact with the side wall 14*b* of the liquid ejecting head 14, by being urged by the cap urging member 46.

A fulcrum PS is a movable fulcrum which allows a rotation in a direction (direction denoted by arrow in FIG. 6) which goes along the opening face 14*a*, and a movement in a direction (movement direction X) intersecting the transport direction Y, while regulating a relative movement of the cap 50 with respect to the liquid ejecting head 14 which goes along the transport direction Y. However, since the tilting movement guiding units 54 is in a state in which a movement in the movement direction X is regulated in the guiding recessed portion 63, the cap 50 moves in a tilting manner in a rotating form, when the pressure receiving protrusion portion 55 which is located at a position separated from the fulcrum PS in the movement direction X receives an urging force of the cap urging member 46.

In this manner, the cap 50 includes the plurality of engaging protrusions 52 which align in a direction (for example, movement direction X) in which the side wall 14*b* extends so as to be engaged with the side wall 14*b* when being moved in the first direction D1 which gets closer to the liquid ejecting head 14, and is held in the holder 60 so as to move in a tilting manner in a direction which goes along the opening face 14*a*.

It is preferable that the engaging protrusion 52 be formed in a shape in which a downstream end (tip end) in the transport direction Y with which the liquid ejecting head 14 is in contact is sharpened, in order to form the fulcrum PS. In addition, the cap urging member 46 may be disposed between the two engaging protrusions 52 (preferably, center) in the movement direction X in which the two engaging protrusions 52 are aligned.

Figure 7:
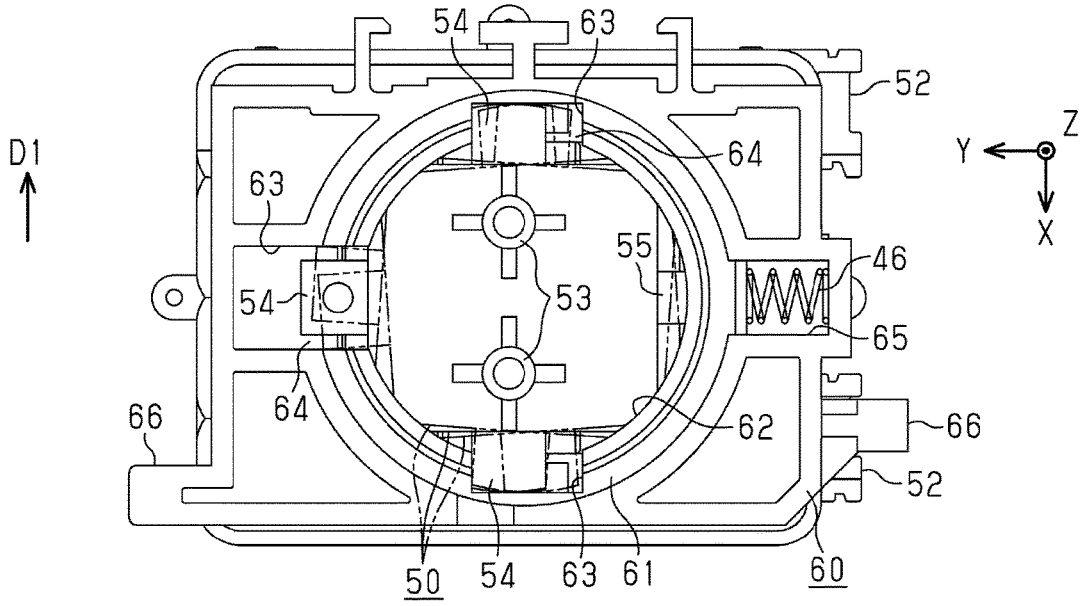
FIG. 7 is a bottom view of a holder which holds a cap according to the first embodiment.

As denoted by a two-dot dashed line in FIG. 7, the lip portion 51 is in pressure contact with the opening face 14*a* of the liquid ejecting head 14, after the cap 50 moves in a tilting manner following the liquid ejecting head 14 which is obliquely attached in the transport direction Y and the movement direction X. In this manner, even in a case in which the liquid ejecting head 14 is obliquely attached, it is also possible to appropriately perform capping so that all of nozzles 13 enter the closed space.

The liquid ejecting head 14 is designed so that the opening face 14*a* becomes parallel to a predetermined reference face (for example, face orthogonal to ejecting direction Z) when being attached to the carriage 15. However, in the liquid ejecting head 14, there is a case in which the opening face 14*a* is attached to the carriage 15 in a state of being tilted to the reference face.

Also in such a case, since the cap 50 and the holder 60 are tilted following the opening face 14*a* when the lip portion 51 is in contact with the opening face 14*a*, when it is set so that the support member 30 supports the cap 50 through the urging member 45, it is possible to prevent airtightness of the closed space from being deteriorated. In addition, in a case in which such tilting of the opening face 14*a* is not a problem, the maintenance unit 20 may not include the urging member 45, and in a case of not including the urging member 45, a configuration in which the holder 60 and the support member 30 are integrated may be adopted.

According to the embodiment, it is possible to obtain the following effects.

(1) Even in a case in which the liquid ejecting head 14 is tilted in a direction which goes along the opening face 14*a*, it is possible to appropriately position the cap 50 with respect to the liquid ejecting head 14 since the cap 50 moves in a tilting manner with respect to the holder 60.

(2) Even in a case in which the opening face 14*a* of the liquid ejecting head 14 is tilted to a predetermined reference face, it is possible to appropriately cause the cap 50 to be in contact with the liquid ejecting head 14, when the urging member 45 urges the cap 50 in a direction of getting closer to the liquid ejecting head 14.

(3) It is possible to adjust a position of the cap 50 in a process of moving the cap to a capping position, by relatively moving the cap 50 with respect to the liquid ejecting head 14.

(4) Since the cap 50 moves along with the support member 30 in conjunction with a movement of the carriage 15, it is possible to move the cap 50 at an appropriate timing, without separately performing a control for moving the cap 50. In addition, it is possible to make a configuration simple, compared to a case in which a driving source for moving the cap 50 is separately provided.

(5) It is possible to cause the cap 50 to follow a posture of the liquid ejecting head 14 by increasing a degree of freedom of a displacement of the cap 50, by adopting a configuration in which the urging member 45 urges the cap 50 through the holder 60.

(6) It is possible to cause the cap 50 to move in a tilting manner using the urging force of the cap urging member 46 when the liquid ejecting head 14 is in contact with any one of the engaging protrusions 52 which protrudes from the cap 50, until another engaging protrusion 52 comes into contact with the liquid ejecting head 14.

Second Embodiment

Subsequently, a second embodiment of the liquid ejecting apparatus 11 will be described with reference to FIGS. 8 and 9.

In the second embodiment, since constituent elements which are given the same reference numerals as those in the first embodiment have the same configuration as that in the first embodiment, descriptions thereof are omitted, and hereinafter, points different from those in the first embodiment will be mainly described.

Figure 8:
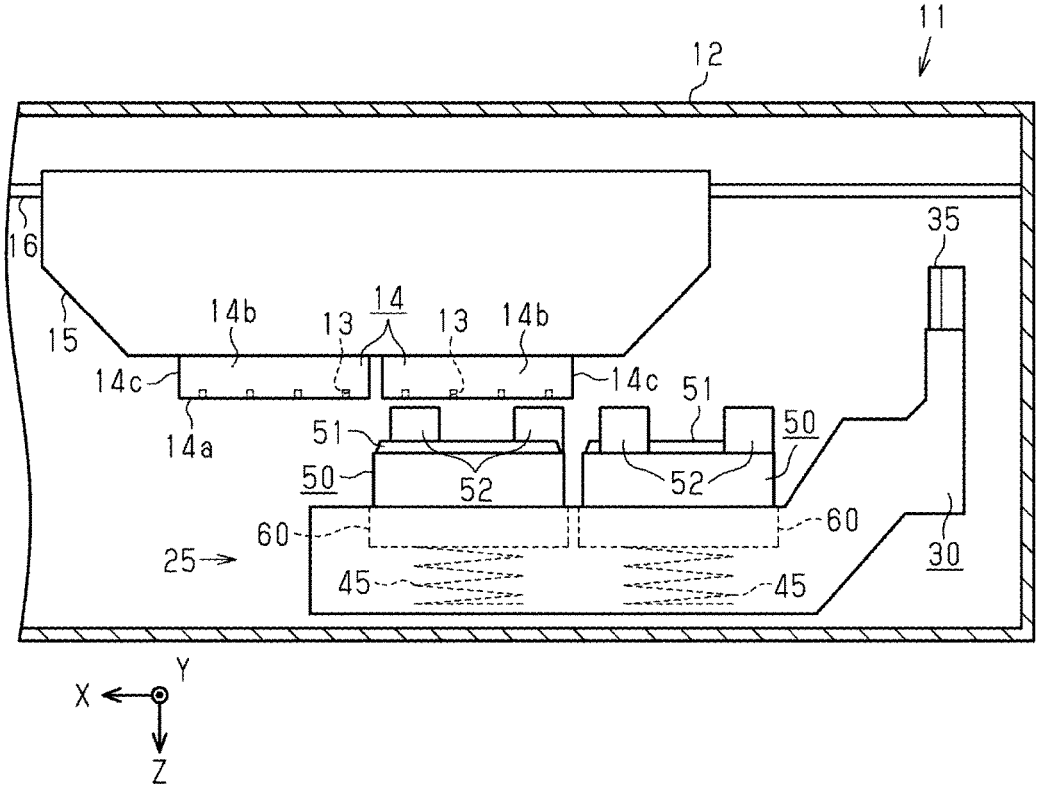
FIG. 8 is a sectional view which schematically illustrates a configuration of a liquid ejecting apparatus according to a second embodiment.

As illustrated in FIG. 8, the liquid ejecting apparatus 11 according to the embodiment is provided with a plurality of (for example, two) liquid ejecting heads 14. A cap unit 25 according to the embodiment is provided with a plurality of caps 50 which are provided corresponding to the plurality of liquid ejecting heads 14, individually, a plurality of holders 60 which are provided corresponding to the plurality of caps 50, individually, and a support member 30 which supports the plurality of holders 60.

Figure 9:
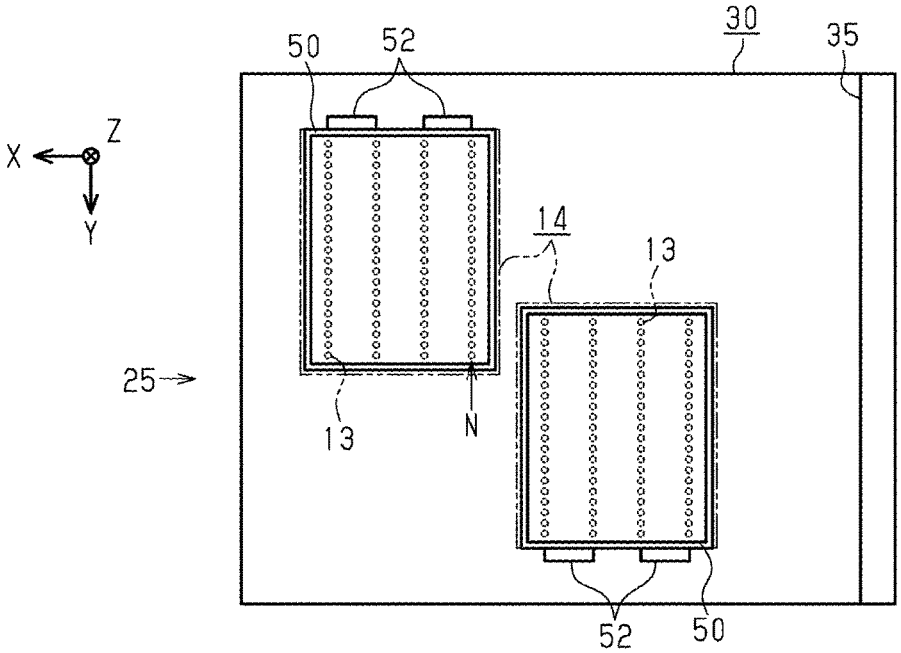
FIG. 9 is a plan view which schematically illustrates a configuration of a cap unit according to the second embodiment.

As illustrated in FIG. 9, the two liquid ejecting heads 14 which align along the movement direction X are disposed so that a part of respective nozzle columns N is shifted in the transport direction Y. In this case, an engaging protrusion 52 of the cap 50 on the upstream side in the transport direction Y may be disposed on the upstream side in the transport direction Y, and an engaging protrusion 52 of the cap 50 on the downstream side in the transport direction Y may be disposed on the downstream side in the transport direction Y. By doing so, it is possible to set so that the liquid ejecting head 14 which goes toward the home position is not in contact with the engaging protrusion 52 unnecessarily, before being in contact with the engaging unit 35 which protrudes from the support member 30.

According to the embodiment, it is possible to obtain the following effects, in addition to the above described effects (1) to (6).

(7) Also in a case in which the plurality of liquid ejecting heads 14 are tilted in different directions, it is possible to appropriately position corresponding caps 50 with respect to the plurality of liquid ejecting heads 14, when the plurality of caps 50 corresponding to the plurality of holders 60 which are supported by the support member 30 move in a tilting manner, individually.

Third Embodiment

Subsequently, a cap unit 25 according to a third embodiment will be described with reference to FIGS. 10 and 11. In the third embodiment, since constituent elements which are given the same reference numerals as those in each of the above described embodiments have the same configuration as that in the corresponding embodiment, descriptions thereof are omitted, and points different from those in the first embodiment will be mainly described.

Figure 10:
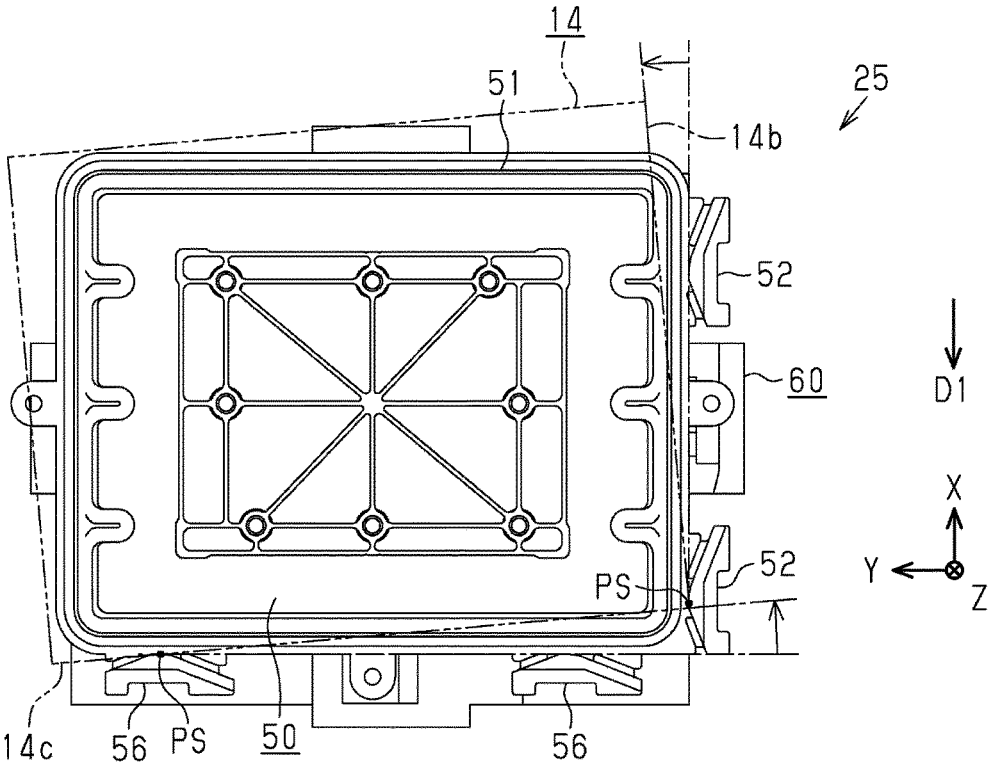
FIG. 10 is a plan view of a cap unit according to a third embodiment.
Figure 11:
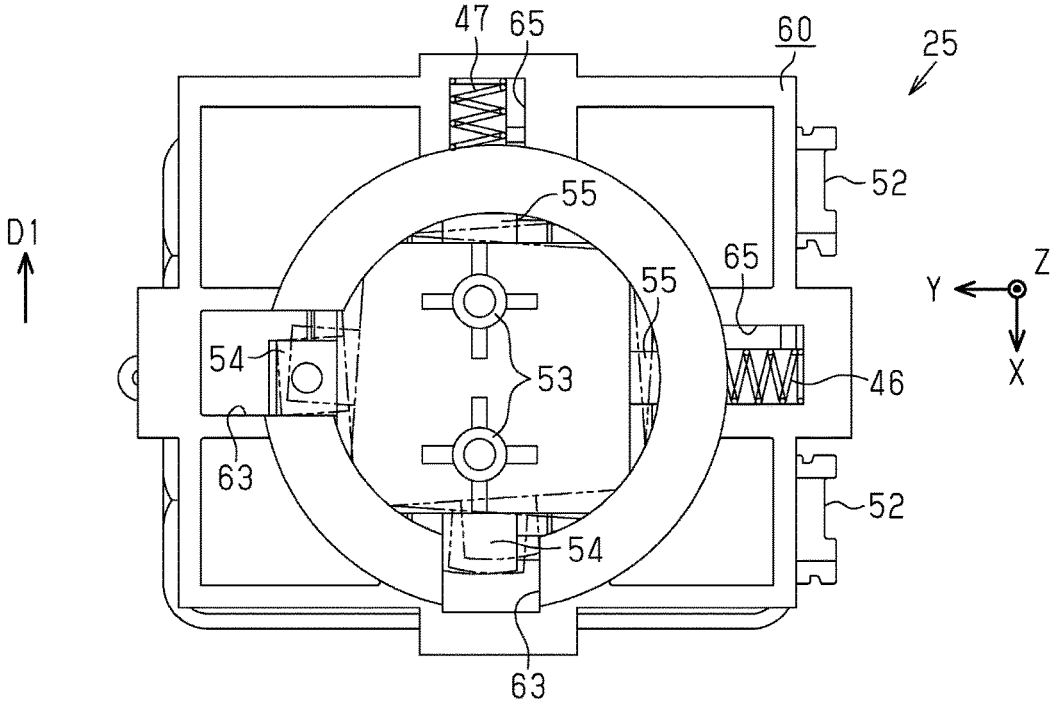
FIG. 11 is a bottom view of the cap unit according to the third embodiment.

In FIGS. 10 and 11, the support member 30 and the urging member 45 which configure the cap unit 25 are not illustrated. The cap 50 and the holder 60 in the embodiment may be supported by one support member 30 one by one, as in the first embodiment, or a plurality thereof may be supported by one support member 30 as in the second embodiment.

As illustrated in FIG. 10, when setting the side wall 14*b* which extends in the movement direction X to the first side wall 14*b*, in the liquid ejecting head 14, a second side wall 14*c* which extends in the transport direction Y intersecting both of the opening face 14*a* and a first side wall 14*b* is included. When setting the engaging protrusion 52 of the cap 50 to a first engaging protrusion 52, the cap 50 according to the embodiment includes a plurality of (for example, two) second engaging protrusions 56 which align in the transport direction Y in which the second side wall 14*c* extends, in a form engaging with the second side wall 14*c*, when the cap moves in the first direction D1 of getting closer to the liquid ejecting head 14.

As illustrated in FIG. 11, when the cap urging member 46 is set to a first urging member 46, the cap unit 25 according to the embodiment is provided with a second urging member 47 which is disposed between the cap 50 and the holder 60, and urges the cap 50 in the movement direction X in which the plurality of second engaging protrusions 56 get closer to the second side wall 14*c*. In this case, the cap 50 may include two tilting movement guiding units 54 and two pressure receiving protrusion portions 55.

Subsequently, an operation of the liquid ejecting apparatus 11 according to the embodiment will be described.

As illustrated in FIG. 10, when the cap 50 comes into contact with the liquid ejecting head 14 by moving in the first direction D1 along with the support member 30, one of the two first engaging protrusions 52 becomes the fulcrum PS by being in contact with the first side wall 14*b* of the liquid ejecting head 14. Alternatively, one of the two second engaging protrusions 56 comes into contact with the second side wall 14*c* of the liquid ejecting head 14, and becomes the fulcrum PS.

When the cap 50 and the liquid ejecting head 14 relatively move along the first direction D1 in this state, the first engaging protrusion 52 which comes into contact with the first side wall 14*b* becomes the fulcrum PS, and the cap 50 moves in a tilting manner, in a form of rotating in a direction denoted by an arrow in FIG. 10, until another engaging protrusion 52 comes into contact with the first side wall 14*b* of the liquid ejecting head 14, using an urging force of the first urging member 46. Alternatively, the second engaging protrusion 56 which comes into contact with the second side wall 14*c* becomes the fulcrum PS, and the cap 50 moves in a tilting manner, in a form of rotating in the direction denoted by the arrow in FIG. 10, until another engaging protrusion 56 comes into contact with the second side wall 14*c* of the liquid ejecting head 14, using an urging force of the second urging member 47.

According to the embodiment, it is possible to obtain the following effects, in addition to the above described effects (1) to (7).

(8) It is possible to cause the cap 50 to move in a tilting manner using an urging force of the first urging member 46, when the liquid ejecting head 14 is in contact with the first engaging protrusion 52 which protrudes from the cap 50, and cause the cap 50 to move in a tilting manner using an urging force of the second urging member 47, when the liquid ejecting head 14 is in contact with the second engaging protrusions 56. Accordingly, it is possible to further accurately position the cap 50 by causing the cap 50 to moves in a tilting manner, in a plurality of directions.

Fourth Embodiment

Subsequently, the cap unit 25 in a fourth embodiment will be described with reference to FIGS. 12 to 17. In the fourth embodiment, since constituent elements which are given the same reference numerals as those in each of the above described embodiments have the same configuration as that in the corresponding embodiment, descriptions thereof are omitted, and points different from those in the each of the embodiments will be mainly described.

In FIGS. 12 to 17, the support member 30 and the urging member 45 which configure the cap unit 25 are not illustrated; however, the cap 50 and the holder 60 in the embodiment may be supported by one support member 30 one by one, as in the first embodiment, or a plurality thereof may be supported by one support member 30 as in the second embodiment.

Figure 12:
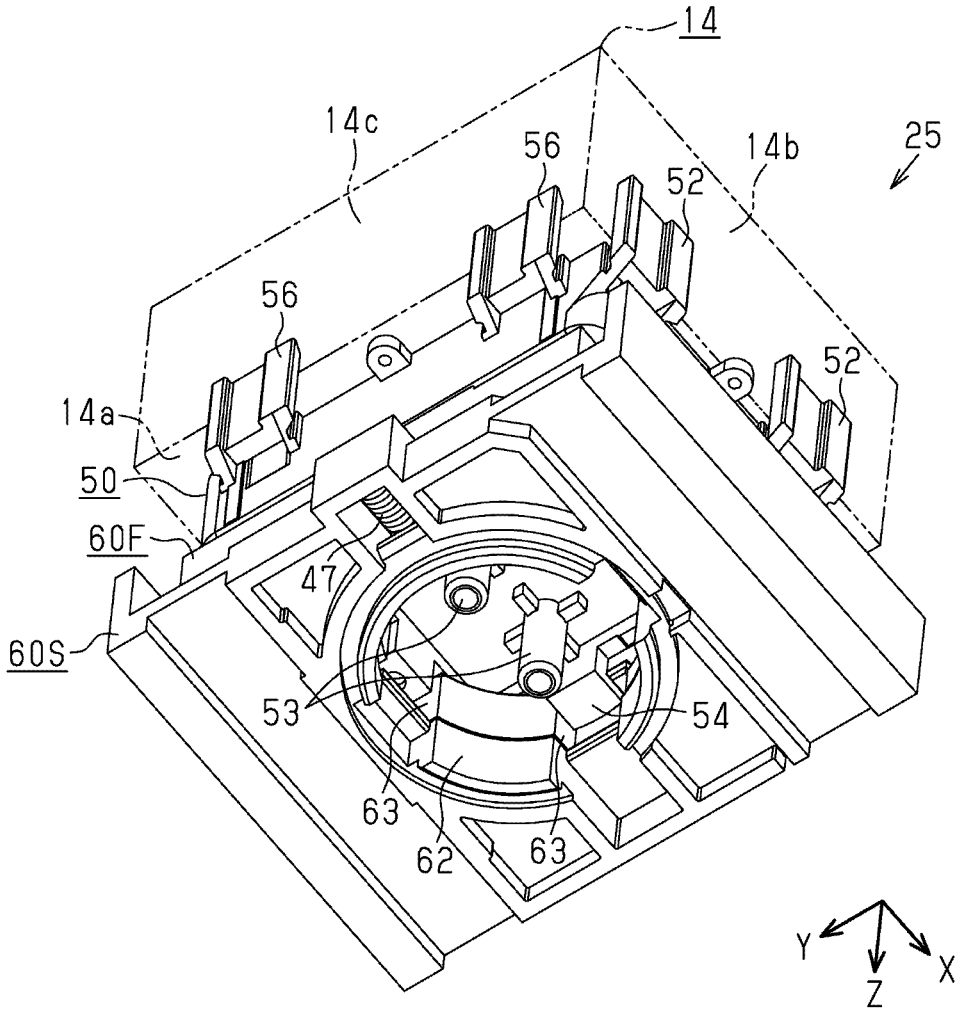
FIG. 12 is a perspective view of a cap unit according to a fourth embodiment which is viewed from below.

As illustrated in FIG. 12, the cap 50 according to the embodiment includes the first engaging protrusion 52 and the second engaging protrusion 56, similarly to that in the third embodiment. In addition, the cap unit 25 according to the embodiment includes the first urging member 46 (refer to FIG. 13), and the second urging member 47 which correspond to the engaging protrusions 52 and 56, respectively. The liquid ejecting apparatus 11 according to the embodiment is provided with a first holder 60F which holds the cap 50, and a second holder 60S which holds the first holder 60F, instead of the holder 60.

Figure 13:
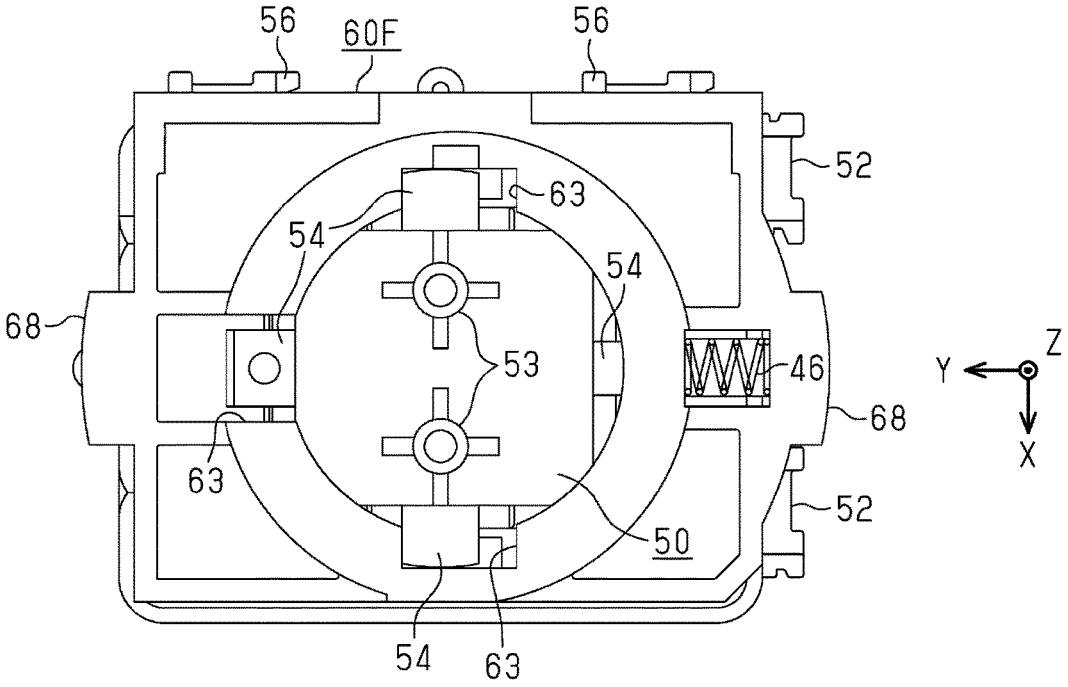
FIG. 13 is a bottom view of a cap and a first holder according to the fourth embodiment.

As illustrated in FIG. 13, the first urging member 46 is disposed between the cap 50 and the first holder 60F. The first holder 60F holds the cap 50 so as to move in a tilting manner in a direction which goes along the opening face 14*a*. In addition, the first holder 60F includes a pair of guiding protrusion portions 68 which is engaged with the second holder 60S.

Figure 14:
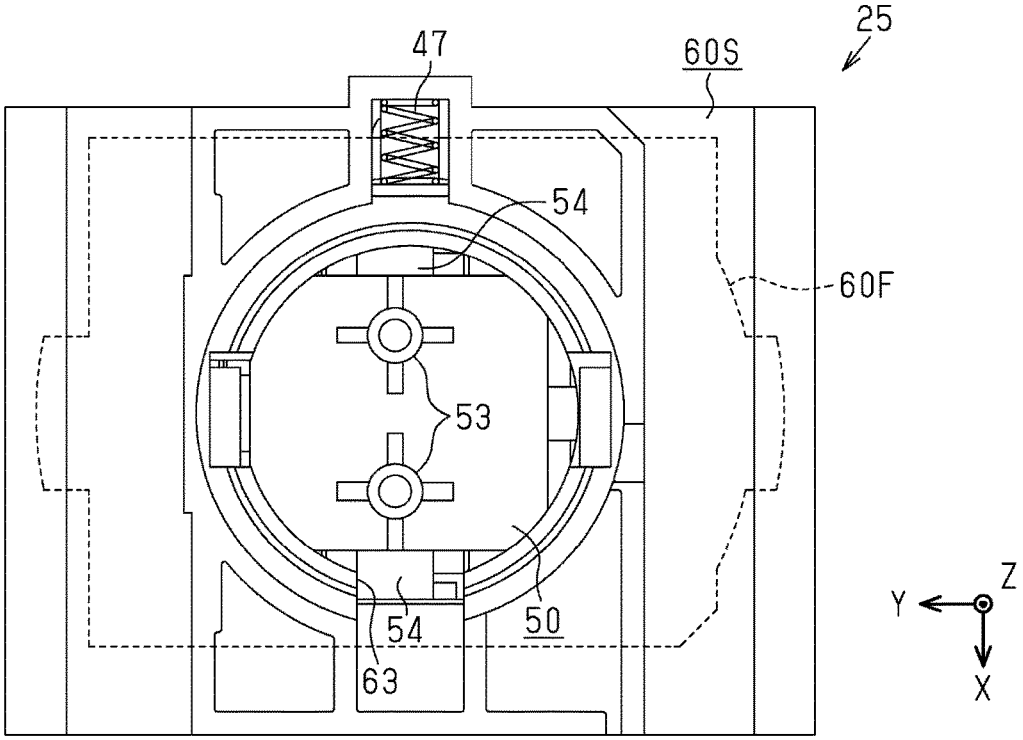
FIG. 14 is a bottom view of a cap unit according to the fourth embodiment.

As illustrated in FIG. 14, the second urging member 47 is disposed between the first holder 60F and the second holder 60S.

Figure 15:
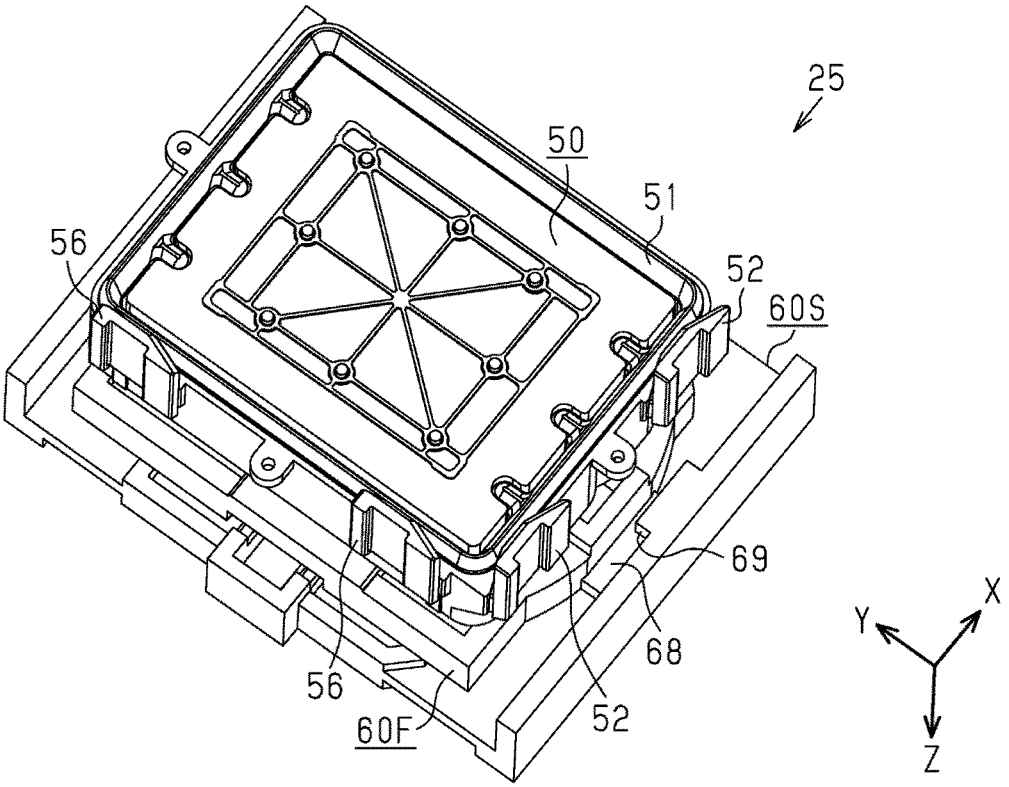
FIG. 15 is a perspective view of the cap unit according to the fourth embodiment which is viewed from above.
Figure 16:
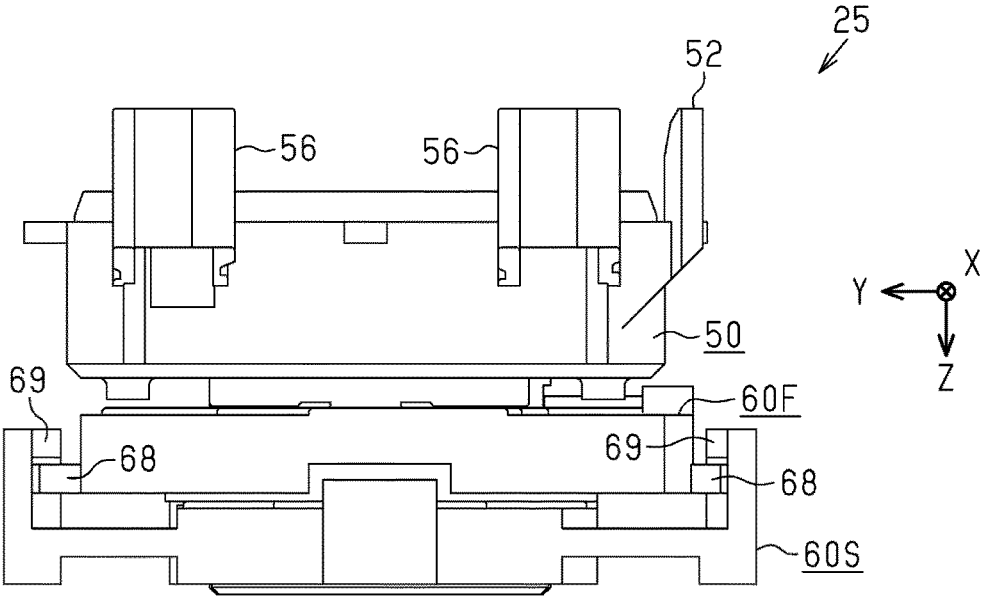
FIG. 16 is a side view of the cap unit according to the fourth embodiment.

As illustrated in FIGS. 15 and 16, the second holder 60S includes a guiding unit 69 which can be engaged with the guiding protrusion portion 68, and holds the first holder 60F so as to move in a tilting manner in a direction which goes along the opening face 14*a*.

Subsequently, an operation of the liquid ejecting apparatus 11 according to the embodiment will be described.

Figure 17:
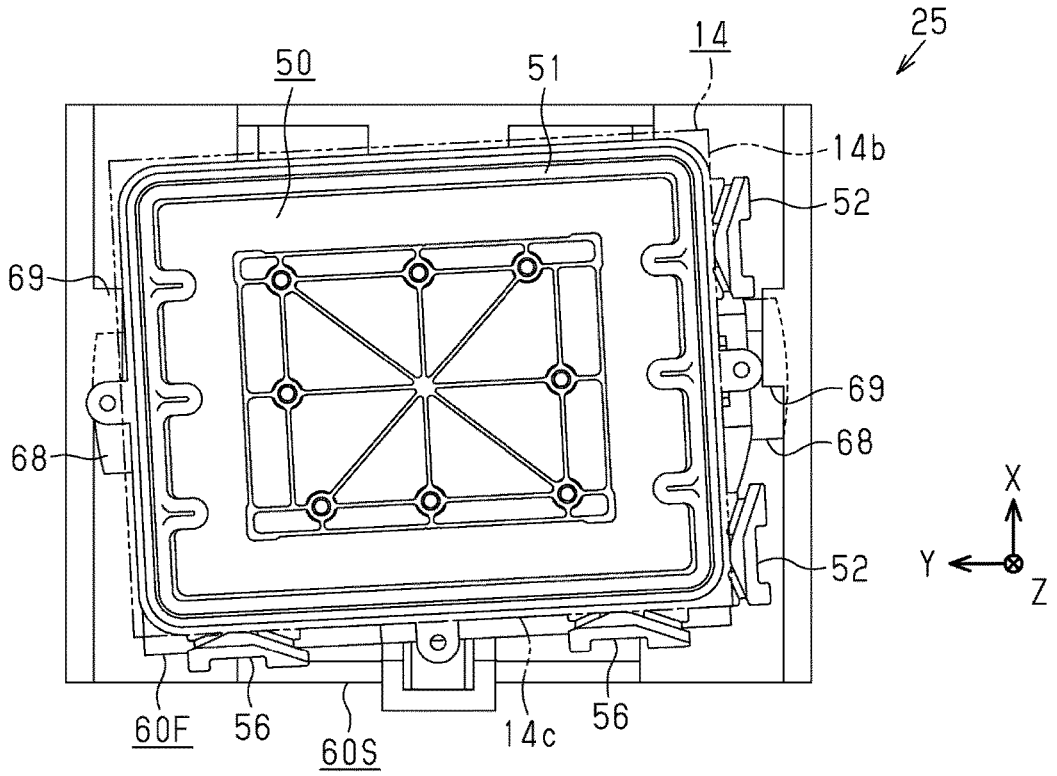
FIG. 17 is a plan view of the cap unit according to the fourth embodiment.

As illustrated in FIG. 17, the cap 50 and the first holder 60F move in a tilting manner with respect to the second holder 60S according to an inclination of the liquid ejecting head 14. In addition, the cap 50 moves in a tilting manner with respect to the first holder 60F according to an inclination of the liquid ejecting head 14.

In the third embodiment, the cap 50 receives urging forces in two directions (movement direction X and transport direction Y) from the first urging member 46 and the second urging member 47 which are disposed between the cap and one holder 60. In addition, since a length of the guiding recessed portion 63 in the two directions is set so as to allow a movement of the tilting movement guiding unit 54 in the two urging directions, there is a case in which the cap 50 moves in a sliding manner in a direction which intersects the urging direction.

In contrast to this, according to the fourth embodiment, the cap 50 receives an urging force in the transport direction Y using the first urging member 46 which is disposed between the cap and the first holder 60F, and the first holder 60F receives an urging force in the movement direction X using the second urging member 47 which is disposed between the first holder and the second holder 60S. For this reason, it is possible to appropriately cause the cap 50 to move in a tilting manner (rotating) by suppressing a sliding movement of the cap 50 in a direction intersecting a direction of receiving an urging force.

According to the embodiment, it is possible to obtain the same effects as those in (1) to (8).

The above described embodiments may be modified as in the following modification examples. In addition, each of the above described embodiments and each of the modification examples can be arbitrarily combined.

The cap 50 in the first and second embodiments may be provided with the plurality of second engaging protrusions 56 which align in the transport direction Y in which the second side wall 14*c* extends, instead of the plurality of first engaging protrusions 52 which align in the movement direction X in which the first side wall 14*b* extends.

The cap 50 forms a closed space by forming a bottomed box shape with a bottom portion and a side wall; however, the closed space may be formed by providing a member corresponding to the lip portion 51 as a side wall or a tip end portion of the side wall on the liquid ejecting head 14 side or the carriage 15 side, and causing both of the members to be in contact by causing a member excluding the lip portion 51 of the cap 50 to relatively move with respect to the member. That is, the cap 50 which forms the closed space may not necessarily be in contact with the liquid ejecting head 14 when performing capping.

The cap unit 25 may not be provided with the first urging member 46 or the second urging member 47.

In a case in which the cap 50 includes the plurality of first engaging protrusions 52 and the plurality of second engaging protrusions 56, the two first engaging protrusions 52 may be disposed at facing sides of a rectangle in a planar view so that the two first engaging protrusions 52 engage with the two first side walls 14*b* of the liquid ejecting head 14 which form a pair, respectively.

In a case in which a direction in which the cap 50 gets closer to the liquid ejecting head 14 (first direction D1) is a direction which goes along a vertical direction, or the like, the engaging protrusions 52 and 56 may be disposed at four sides which form a rectangle in a planar view of the cap 50. In this case, it is preferable to provide a taper with a tapered tip end in the engaging protrusions 52 and 56, or curve an angle of a tip end portion of the engaging protrusions 52 and 56, in order to cause the engaging protrusions 52 and 56 and the liquid ejecting head 14 to be engaged smoothly.

The liquid ejecting head 14 may perform capping by moving in a direction of getting closer to the cap 50.

The plurality of engaging protrusions 52 which align in a direction in which the first side wall 14*b* extends may be a plate-shaped protrusion which extends in a direction in which the first side wall 14*b* extends. In addition, the plurality of engaging protrusions 56 which align in a direction in which the second side wall 14*c* extends may be a plate-shaped protrusion which extends in a direction in which the second side wall 14*c* extends.

It may be a configuration in which the support member 30 moves in the first direction D1 using a driving force of a separated driving source, without being linked with a movement of the carriage 15. For example, it may be a configuration in which capping is performed when the support member 30 which supports the cap 50 moves in the first direction D1 which goes along the transport direction Y.

The liquid ejecting apparatus 11 may be a line head printer which includes a line head including a plurality of liquid ejecting heads 14 which are disposed in parallel so that a printing range stretches to the entire width of a medium S as a constituent element. In this case, it is possible to adopt a configuration in which the cap 50 and the medium support unit 17 alternately move in a region in which the line head ejects liquid. Alternatively, a line head may move to a position of facing the medium support unit 17, and a position of facing the cap 50.

Liquid ejected from a liquid engaging unit is not limited to ink, and for example, may be a liquid body which is obtained by dispersing or mixing particles of a functional material in liquid. For example, it may be a configuration in which recording is performed by ejecting a liquid body including a material such as an electrode material, or a coloring material (pixel material) which is used when manufacturing, for example, a liquid crystal display, an electroluminescence (EL) display, and a surface emission display in a form of dispersion or dissolution.

A medium is not limited to a sheet, and may be a plastic film, a thin plate member, or the like, or may be cloth which is used in a textile printing apparatus, or the like.

The entire disclosure of Japanese Patent Application No. 2016-013057, filed Jan. 27, 2016 is expressly incorporated by reference herein.

What is claimed is:

1. A liquid ejecting apparatus comprising:

a liquid ejecting head including a nozzle which ejects liquid, and an opening face to which the nozzle opens;

a cap which forms a closed space between the cap and the opening face, the cap including a plurality of engaging portions that are capable of engaging with a surface of the liquid ejecting head different from the opening face; and a holder which holds the cap, the cap being rotatable around an axis that intersects a plane along the opening face until the liquid ejecting head engages with the plurality of engage portions.

2. The liquid ejecting apparatus according to claim 1, further comprising:

a plurality of the liquid ejecting heads;

a plurality of the caps which are provided corresponding to the plurality of liquid ejecting heads, individually;

a plurality of the holders which are provided corresponding to the plurality of caps, individually; and a support member which supports the plurality of holders.

3. The liquid ejecting apparatus according to claim 1,
wherein the cap is capable of moving between a capping position at which the closed space is formed and an open position which is separated from the capping position.

4. The liquid ejecting apparatus according to claim 1, further comprising:
a carriage which reciprocates in a state in which the liquid ejecting head is mounted thereon; and
a support member which supports the holder,
wherein the cap moves along with the support member in conjunction with a movement of the carriage.

5. The liquid ejecting apparatus according to claim 1, further comprising:
a support member which supports the holder; and
an urging member which is provided between the holder and the support member, and urges the cap in a direction of getting closer to the opening face through the holder.

6. The liquid ejecting apparatus according to claim 1, further comprising:
a cap urging member which is disposed between the cap and the holder,
wherein the liquid ejecting head includes a side wall which extends in a direction which intersects the opening face,
wherein the cap includes a plurality of the engaging portions, and
wherein the cap urging member urges the cap in a direction in which the plurality of the engaging portions get closer to the side wall.

7. The liquid ejecting apparatus according to claim 6, further comprising:
a second urging member which is disposed between the cap and the holder,
wherein, when the side wall is set to a first side wall, the engaging portion is set to a first engaging portion, and the cap urging member is set to a first urging member, the liquid ejecting head includes a second side wall which extends in a direction which intersects both of the opening face and the first side wall,
wherein the cap includes a plurality of second engaging portions, and
wherein the second urging member urges the cap in a direction in which the plurality of the second engaging portions get closer to the second side wall.

8. The liquid ejecting apparatus according to claim 1,
wherein the liquid ejecting head ejects the liquid in an ejecting direction, and
wherein the holder holds the cap, the cap being movable in the direction which goes along the opening face and tillable about the ejecting direction upon engagement of the cap with the liquid ejecting head.

9. The liquid ejecting apparatus according to claim 1, wherein a plane along the surface of the liquid ejecting head different from the opening face intersects a plane along the opening face.

10. A liquid ejecting apparatus comprising:
a liquid ejecting head including a nozzle which ejects liquid, and an opening face to which the nozzle opens;
a cap which forms a closed space between the cap and the opening face, the cap including a plurality of the engaging portion that is capable of engaging with a surface of the liquid ejecting head different from the opening face; and
a holder which holds the cap,
wherein the cap rotates around an axis that intersects a plane along the opening face until the liquid ejecting head engages with one engaging portion and then engages with other engaging portion.

11. A liquid ejecting apparatus comprising:
a liquid ejecting head including a nozzle which ejects liquid, and an opening face to which the nozzle opens;
a cap which forms a closed space between the cap and the opening face, the cap including at least one engaging portion that is capable of engaging with a surface of the liquid ejecting head different from the opening face;
a holder which holds the cap, the cap being rotatable around an axis that intersects a plane along the opening face when the engaging portion engages with the liquid ejecting head; and
a spring urging member which urges the cap in a direction of getting closer to the opening face.

* * * * *